United States Patent [19]

Stuyvenberg

[11] Patent Number: 4,791,786

[45] Date of Patent: Dec. 20, 1988

[54] FREE-PISTON MOTOR WITH HYDRAULIC OR PNEUMATIC ENERGY TRANSMISSION

[75] Inventor: Paulinus F. Stuyvenberg, Schiedam, Netherlands

[73] Assignee: De Rotterdamsche Droogdok Maatschappij, Rotterdam, Netherlands

[21] Appl. No.: 75,618

[22] Filed: Jul. 20, 1987

[30] Foreign Application Priority Data

Jul. 25, 1986 [NL] Netherlands ..... 8601931

[51] Int. Cl.[4] ..... F02B 71/04

[52] U.S. Cl. ..... 60/595; 417/380

[58] Field of Search ..... 60/595; 123/46 R, 46 B; 417/323, 364, 380

[56] References Cited

U.S. PATENT DOCUMENTS

| | | | |
|---|---|---|---|
| 2,978,986 | 4/1961 | Carder et al. . | |
| 4,307,999 | 12/1981 | Vanderlaan | 417/324 |
| 4,308,720 | 1/1982 | Brandstadter | 60/595 |
| 4,382,748 | 5/1983 | Vanderlaan | 417/11 |

FOREIGN PATENT DOCUMENTS

| | | |
|---|---|---|
| 45472 | 2/1982 | European Pat. Off. . |
| 398207 | 5/1909 | France . |
| 913415 | 9/1946 | France . |
| 2105967 | 4/1972 | France . |
| 2212486 | 7/1974 | France . |

*Primary Examiner*—Stephen F. Husar

*Attorney, Agent, or Firm*—Dennison, Meserole, Pollack & Scheiner

[57] ABSTRACT

A free-piston motor with hydraulic or pneumatic energy transmission comprising at least one free-piston unit designed for intermittent operation using always the same optimal cycle comprising a compression and an expansion stroke and consisting of a cylinder (88) with at least one free piston (89) which is slidable to-and-fro therein, said piston (89) being connected to a member (90) of general plunger-like shape which is adapted to slide to-and-fro inside at least one stationarily mounted chamber member (95) and which delimits within said chamber member a first or plunger chamber (93) which is in communication with a source of pressurized fluid (103) through an operable valve member (82,83), a second or displacement chamber (96) which is in communication via a nonreturn valve (99) with a reservoir (100) and is connected via a second nonreturn valve (102) to an accumulator (103), and a third or buffer chamber (97) which is in open communication with said accumulator (103). Preferably the cylinder (88) contains two free pistons (89, 89') and both plunger chambers (93, 93') are in communication with said source of pressurized fluid (103) through one common operable valve member, the displacement chambers being each in communication with the accumulator via a pipe incorporating an operable valve member, or each plunger chamber (93, 93') is in communication with said source of pressurized fluid (103) through its own separate operable valve member (82, 83), so that during the waiting time after each cycle the piston positions can be corrected if necessary.

15 Claims, 4 Drawing Sheets

FREE-PISTON MOTOR WITH HYDRAULIC OR PNEUMATIC ENERGY TRANSMISSION

Figure 1:
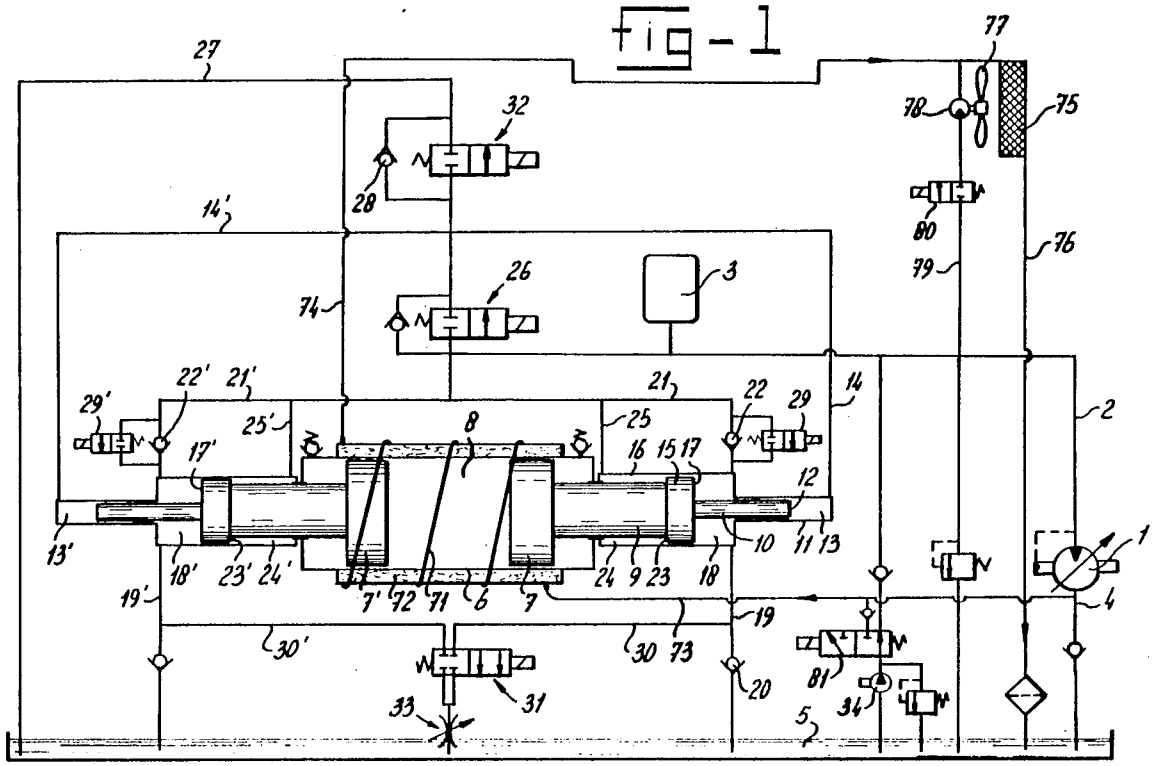

The invention relates to an apparatus for driving a member, such as a wheel, pulley, rod or similar member, comprising at least one rotary or linear motor which is coupled to said member and is driven by a pressurized fluid, particularly a hydraulic motor or similar hydraulic apparatus, which on one side is in communication via a pipe with at least one accumulator for a pressurized fluid, particularly a liquid, and on the other side with an outlet leading to a reservoir for said liquid, and further comprising at least one free-piston unit consisting of a cylinder with at least one free piston which is slidable to-and-fro therein and which delimits a space within the cylinder in such a manner that on the expansion stroke of the piston, during which the latter is moved in the one direction, the volume of the space is increased, while on the compression stroke of the piston, during which the latter is displaced in the other direction, the volume of the space is reduced, while means are provided for the admission and discharge of a gas into and out of said space respectively, together with means for heating the gas compressed in said space by the compression stroke of the piston, the latter being connected to a member of general plunger-like shape which is adapted to slide to-and-fro inside at least one stationarily mounted chamber member, at least two parts of different diameters of the periphery of the plunger-shaped member making sliding fits with parts of the inside wall of the chamber member, while the plunger-shaped member has three substantially radial surfaces each of which delimits within the chamber member a substantially closed chamber whose capacity gradually varies as the piston makes its expansion and compression strokes, of which surfaces a first radial surface delimits a first or plunger chamber which is in communication with a source of pressurized fluid, and a second radial surface delimits a second or displacement chamber which is in communication via a nonreturn valve with the reservoir and is connected via a second nonreturn valve to the accumulator, so that during the stroke of the piston whereby the capacity of the second chamber is increased liquid is drawn out of the reservoir into this chamber and during the other, opposite stroke of the piston whereby the capacity of the second chamber is reduced this liquid is forced out of said chamber in order to load the accumulator, and the third radial surface has a smaller operative area than the first radial surface and delimits substantially inside the chamber member a third chamber, while its capacity increases and decreases respectively during the expansion and compression strokes of the piston. Such apparatus is known from U.S. Pat. No. 4,382,748.

In an apparatus of this type the accumulator is filled during operation with a fluid, particularly a liquid, such as oil, under high pressure. Through an adjustment of a regulatable control slide valve connected to a fixed linear or rotary hydraulic motor, oil is caused to flow out of the accumulator to the hydraulic motor and from the latter to the liquid reservoir, while mechanical power is delivered to the output shaft of the hydraulic motor, and the pressure in the accumulator will decrease.

In the prior art apparatus a pair of free piston moves in line reciprocation in a cylinder each of said pistons being connected with a pump piston slidably movable in a pump cylinder and with a compression piston slidably movable with said pump piston in a compression cylinder so that the first, second and third chambers mentioned herein above are formed.

The first plunger chamber is in open communication with a source of pressurized fluid. Both second and third chambers are in communication with a low pressure inlet or reservoir through a nonreturn valve and with the accumulator also through a nonreturn valve. However the nonreturn valves in the communication between the second chamber and the accumulator and between the third chamber and the reservoir can be by-passed by opening first and second operable valves respectively whereas the nonreturn valve through which the third chamber is in communication with the accumulator can be made inoperative by closing a third operative valve.

In a primary mode of operation the first and third operable valves are closed and the second operable valve is open so that the third chamber is solely in open communication with the reservoir and serves only as a means for interrupting the normal cycling motion with s pause period, the second operable valve then being closed so that said third chamber forms a pressure lock at the end of an expansion stroke, and as a means for resetting the free piston in starting the free piston engine, a high pressure fluid from an external source then being introduced into the third chamber whereas the second chamber is vented to inlet pressure by means of a reset spool valve and a reset actuator.

In a secondary mode of operation the second operable valve is closed and the first and third operable valves are open so that then the third chamber forms the pump chamber instead of the second chamber as in the first mode of operation.

The prior art apparatus is designed for a continuous reciprocating motion of the free pistons at a predetermined cycle rate what makes it necessary that the free pistons are mechanically interconnected since for a smooth operation of a free piston engine having two pistons the starting positions of said pistons at each cycle must lie within determined tolerance limits. However, such mechanical interconnection of the free pistons makes the engine complicated.

The invention seeks to provide an apparatus of the kind defined which does not have said disadvantage, in that the free-piston unit according to the invention can work most effectively in intermittent operation, using always the same optimal cycle, that is to say the unit is stopped after each cycle comprising a compression and an expansion stroke, so that during the waiting time after each expansion stroke, the piston positions can be corrected, if necessary.

This aim is achieved in that in the apparatus according to the invention the first or plunger chamber is in communication with said source of pressurized fluid through an operable valve member so that by opening said valve member the piston makes it compression stroke and the third chamber is solely in open communication with said accumulator so that at the end of the expansion stroke the third chamber forms a buffer chamber filled with liquid and in communication with the accumulator. In this arrangement the buffer chamber is preferably also in communication, via a pipe provided with a nonreturn valve, with the displacement chamber.

In an apparatus constructed in this manner, when the pressure in the accumulator has reached a specific minimum value, the operable valve member is brought to the open position, so that the pressurized fluid flows from the source, preferably oil from the accumulator, into the plunger chamber, and through the resulting pressure applied to the first radial surface the piston will be caused to make the compression stroke, while oil is also drawn into the displacement or liquid chamber. The gas pressure in the cylinder chamber thus rises, and after the piston has reached a determined position a fuel, for example, is injected into the chamber and is burned, the burning preferably being initiated by self-ignition combustion, so that the pressure in the chamber rises sharply with the consequence that the piston is moved in the opposite direction to make the expansion stroke. During this expansion stroke the oil drawn into the displacement chamber is displaced to the accumulator and the fluid in the plunger chamber is forced back to the source. During the expansion stroke the valve member is brought back to the closed position, so that the movement of the free piston stops close to the end of the expansion stroke.

During the expansion stroke of the free piston the fluid in the displacement and plunger chambers is thus under pressure, so that at the end of this stroke as a result of the compressibility of the fluid, said fluid will have the tendency to move the free piston a considerable distance in the opposite direction, when the piston would encounter practically no resistance in that direction as in the prior art apparatus. However, in the apparatus of the invention such resistance is present in that at the end of the expansion stroke the third chamber forms a buffer chamber filled with liquid and in communication with the accumulator whereas during the expansion stroke a part of the oil displaced from the displacement chamber to the accumulator is delivered to the buffer chamber, so that when the movement of the piston is reversed at the end of the expansion stroke, this movement will be braked by the pressure acting on the third radial surface. In addition, a part of the compression energy of the oil in the plunger and liquid chambers is recovered, in that oil is displaced by the third radial surface to the accumulator.

Preferably two free pistons are disposed in the cylinder, which move towards one another in the compression stroke and away from one another in the expansion stroke.

According to the invention in that case either both plunger chamber are in communication with the source of pressurized fluid through one common operable valve member or each plunger chamber is in communication with said source through its own separate operable valve member.

In the latter case, by opening one of said valve members slightly before the other valve member, a divergence from the symmetrical position of the pistons in their outermost positions inside the cylinder can be corrected in that then the compression stroke of the piston situated most to the outside is initiated in advance of the compression stroke of the other piston. For a smooth operation of the free-piston unit comprising two pistons it is necessary for the starting positions of the free pistons to lie within determined tolerance limits. An other advantage of this configuration is a reduced average waiting time between cycles, resulting in a higher maximum power output.

In order to have also in the former case the possibility to correct a divergence from the symmetrical position of the pistons, in that case the liquid chambers are each in communication, via a pipe incorporating an operable valve member, with the accumulator. During the waiting time after each expansion stroke it is then possible, if necessary, for one or both of the two valve members, to be operated in order to correct the piston positions.

The plunger chamber and the displacement chamber may preferably each be brought into communication with the reservoir via an operable valve. By opening these valves the free piston can be brought into the correct starting position for the purpose of starting up the unit after a lengthy stoppage, since because of the oil pressure still acting on the third surface the piston will be moved outwards.

Advantageously a preferably adjustable constriction is then preferably provided downstream of the operable valve in the connection between the displacement chamber and the reservoir, whereby the speed of the free piston can be controlled in its movement to the starting position.

In view of the fact that in an apparatus according to the invention a substantially constant pressure prevails in the hydraulic system, the ratio between the amount of heat given out by the aforesaid space inside the cylinder and the amount of delivered oil is nearly constant. The cylinder of the unit can therefore be provided in an advantageous manner with jacketing for the purpose of cooling the cylinder by means of the liquid, this jacketing being at one end in communication with the hydromotor outlet leading to the reservoir and at the other end in communication with the reservoir via a cooler.

The cooler preferably contains a hydraulically driven fan, the drive of which is connected at one end to the accumulator and at the other end via the cooler to the reservoir, so that this fan can be switched on if the temperature exceeds an acceptable maximum level.

In view of the fact that it is of great importance that in the apparatus according to the invention the operable valve members, particularly the regulating valve members, should be valves which open and close rapidly, these valve members are according to the invention so constructed that they comprise a body which is provided with respective connections to the high and low pressure parts of the pip concerned and which has at least one through passage in which a valve element is received, with its bottom face resting on a seat, an is adapted to be moved away from and towards said seat, this passage being in communication at one end with the high pressure connection and at the other end with the low pressure connection, so that the high pressure acts on the top face and the low pressure on the bottom face of the valve element, and beneath the latter a pin-like member is disposed which is slidable inside a bore away from and towards the valve element and has at least one substantially radial surface delimiting inside the bore a substantially closed space which is in communication, via preloaded nonreturn valves with the high pressure connection, so that this space is always filled with the liquid under high pressure, while means are provided for raising the pressure and supplying liquid, so that the pin-like member is thereby displaced an the valve element is lifted off its seat. In this arrangement the aforesaid surface of the pin-like member is preferably formed by a shoulder surface provided on the pin-like member and directed away from the valve member, while the bore in which said pin-like member is received is in communication at the bottom end with the high pressure connection, so that the high pressure acts on that end surface of the pin-like member which is situated at a distance from the shoulder surface. The means for raising the pressure advantageously consist of at least one piezoelectric element by which an electric signal with a short time delay and short switching time is converted into a mechanical signal of great power and short stroke.

In view of the fact that the apparatus according to the invention offers many possible forms of regulation for the piston movements and positions, it is preferable to use two free pistons which during the compression stroke move towards one another and during the expansion stroke move away from one another, while in the cylinder inlet and outlet ports are provided which are disposed symmetrically in relation to the centre of the cylinder, and according to the invention one free piston has a lower mass than the other free piston. In an apparatus constructed in this manner the lighter piston will thus be the first, during the expansion stroke, to open the outlet ports situated on the side where this piston is disposed, and during the compression stroke will be the first to close them, which will have an advantageous effect on the scavenging of the chamber. In addition, this difference in mass will have a favourable influence on the combustion process. By adaptation of the various plunger surface areas it is possible to influence still further the strokes and the movement cycles of the free pistons in order to optimize the effect described above. Thus in the previous described construction the movement of the pistons is typically asymmetrical.

Figure 2:
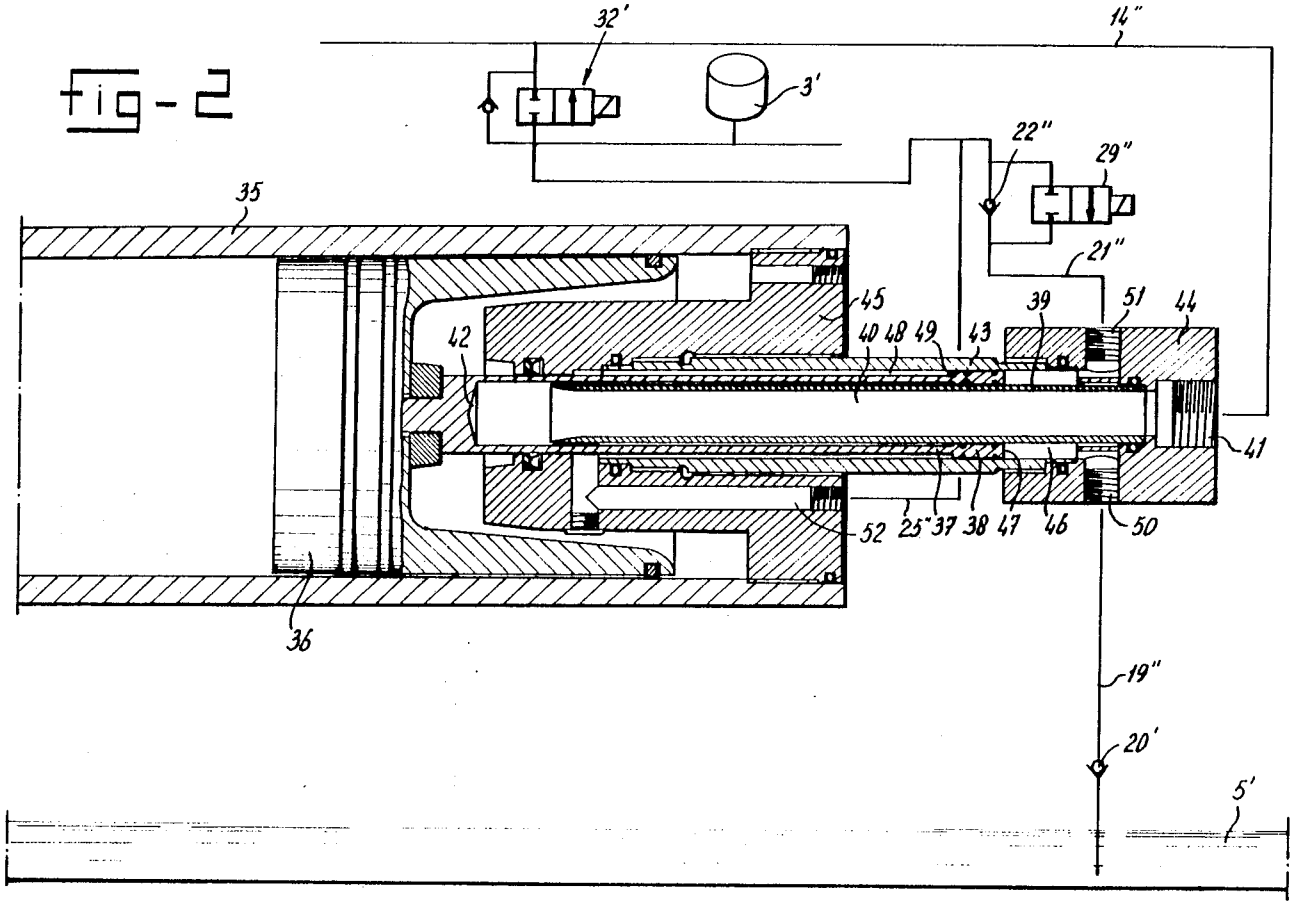
Figure 3:
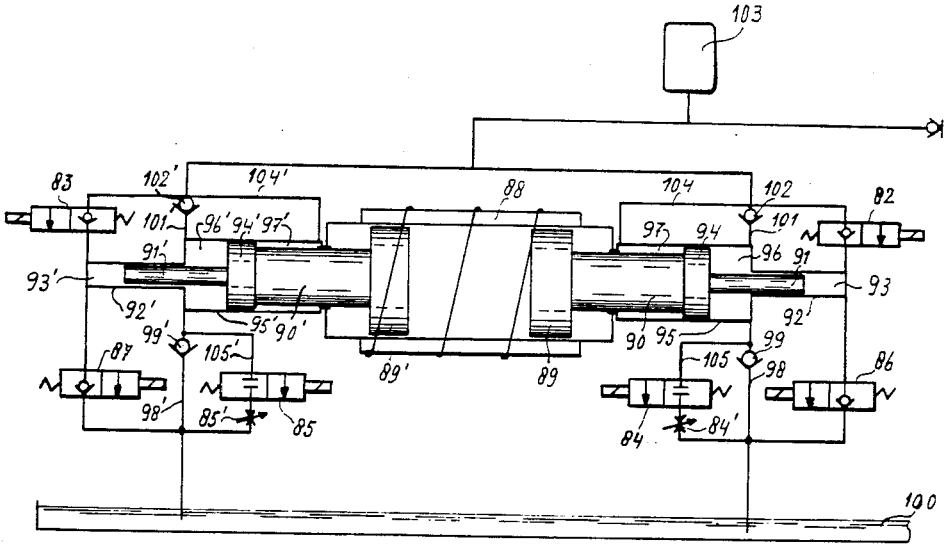
Figure 4:
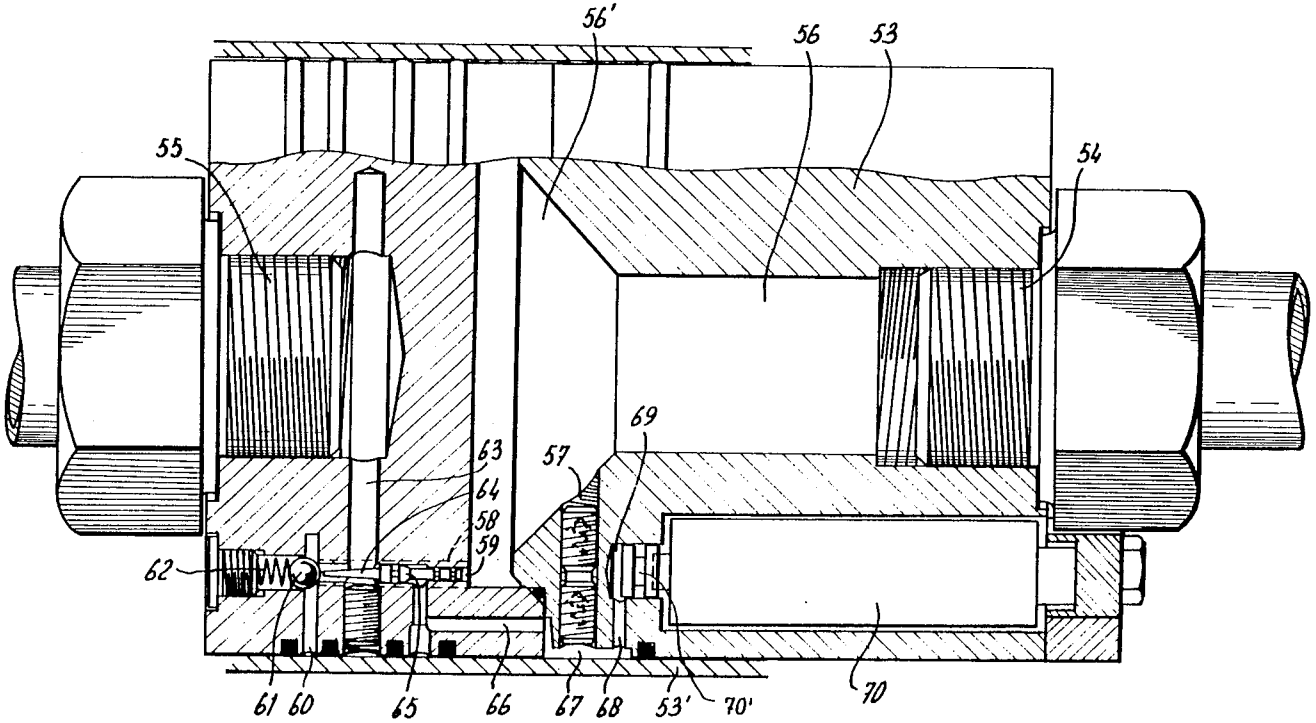

The invention will now be explained more fully with reference to the drawings, in which:

FIG. 1 shows schematically a first form of construction of the apparatus according to the invention, FIG. 2 is an axial section of another form of construction of the piston-plunger assembly shown in FIG. 1, FIG. 3 shows schematically another possible form of construction of the apparatus according to the invention, and FIG. 4 is an axial section of a valve member used in an apparatus according to the invention.

As shown in FIG. 1, the apparatus comprises in this case a variable hydraulic motor 1, which is connected via the pipe 2 to an accumulator 3 for pressurized liquid and which has an outlet 4 for this liquid, leading to a reservoir 5 which may optionally be under a low superatmospheric pressure.

In addition, a free-piston unit is provided which consists of a cylinder 6 containing two free pistons 7 and 7' which are reciprocatingly slidable therein and which during the compression stroke move towards one another and during the expansion stroke move away from one another, said free pistons together delimiting a space 8 inside the cylinder 6. This space is for example in the form of a combustion chamber, the wall of the cylinder 6 being in that case provided with inlet and outlet ports (not shown), while means (not shown) for injecting a fuel into the combustion chamber 8 are provided, so that the combustion of said fuel takes place in accordance with the two-stroke diesel principle.

The pistons 7 and 7' are substantially identical, so that only the piston 7 will be further described, the same reference numerals with the addition of a prime being used to designate corresponding parts of the piston 7'.

The piston 7 is connected to a plunger-shaped member 9, which comprises a first part 10 adapted to slide reciprocatingly inside a chamber member 11, the outer peripheral surface of said part 10 making a sliding fit with the inside wall of the chamber member 11, so that the end surface 12 of said part 10 delimits inside the member 11 a plunger space 13 which is in communication with the accumulator 3 via a pipe 14 and a valve system 26. The plunger-shaped member 9 has a second part 15, the outer peripheral surface of which makes a sliding fit with the inside surface of a second chamber member 16 and which has a first annular end face 17 which delimits a displacement chamber 18 inside the chamber member 16. This displacement chamber 18 is in communication via a pipe 19, provided with a nonreturn valve 20, with the liquid reservoir 5, and via a pipe 21, provided with a nonreturn valve 22, with the accumulator 3. The second part 15 of the plunger-shaped member 9 also has a second annular end face 23, which is directed oppositely to the end face 17 and which delimits a buffer chamber 24 inside the second chamber member 16. This buffer chamber 24 is in communication via a line 25 not only with the accumulator but also via the valve 22 or 29 with the displacement chamber 18.

The pipes 14, 14' contain an operable valve member 26, so that on the opening of this valve, which takes place after the pressure in the accumulator 3 has fallen below a specific minimum level, the plunger chambers 13, 13' are brought into open communication with the accumulator 3, whereby because of the liquid pressure acting on the faces 12, 12' the pistons 7, 7' are driven towards one another for the performance of the compression stroke, the gas pressure in the chamber 8 thus rising. At the same time liquid is also drawn out of the reservoir 5, via the pipes 19, 19' and valves 20, 20', into the displacement chambers 18, 18'. After the pistons 7, 7' have reached a determined position, fuel is injected into the chamber 8, the burning of which is initiated by self-ignition combustion, so that the gas pressure in the chamber 48 rises sharply, with the consequence that the pistons are moved away from on another for the performance of the expansion stroke. During this expansion stroke, liquid present in the plunger chambers 13, 13' and liquid from the chambers 18, 18' are displaced via respective pipes 14, 14' and 21, 21' to the accumulator 3, while a part of these last-mentioned liquid flows is also passed via the pipes 25, 25' to the buffer chambers 24, 24'. As the end of the expansion stroke approaches, the valve 26 is closed again. At the end of the expansion stroke the movements of the pistons are reversed because of the compressibility of the liquid still present in the chambers 13, 13' and 18, 18', while however the pistons 7, 7' are braked by the liquid pressure acting on the surfaces 23, 23' of the buffer chambers 24, 24'. In order then to prevent the occurence of cavitation in the chambers 13, 13', the pipes 14, 14' are connected via the pipe 27, containing the nonreturn valve 28, to the liquid reservoir 3, so that liquid can be drawn via the pipes 27, 14, 14' into the plunger chambers 13, 13'.

In order to ensure good operation of the free-piston motor it is of great importance that after each expansion stroke the starting positions of the pistons 7, 7' should lie within close tolerance limits. To enable these starting positions to be corrected during the waiting time after an expansion stroke, the operable valve members 29, 29' are provided. By opening one or both of these valve members, the respective piston 7, 7' can be slightly displaced in the direction of the other piston in view of the fact that the displacement chamber 18, 18' is thereby brought into open communication with the accumulator 3, so that the liquid pressure prevailing in the accumulator 3 acts on the surface 17, 17' which has a larger working area than the surface 23, 23 of the buffer chamber 24, 24'.

In addition, the displacement chambers 18, 18' can be brought into open communication with the liquid reservoir 5 via the pipes 30, 30' through the opening of the valve members 31, while the plunger chambers 13, 13' can be similarly brought into open communication with the liquid reservoir 5 via the pipes 14, 14', 27 through the opening of the valve member 32, so that because of the liquid pressure acting on the surfaces 23, 23' of the buffer chambers 24, 24' both the pistons 7, 7' can be brought into the correct outer starting position, which is of particular importance when the free-piston motor is started up after a long stoppage.

Furthermore, an adjustable constriction 33 is provided, by means of which the speed at which the pistons 7, 7' are brought to the outer starting positions can be adjusted. Moreover, when a cold motor has to be started, this constriction can be used to control the pressure in the displacement chambers 18, 18', in which case only the valve member 31 is operated. This is necessary in order to maintain a constant stroke of the free piston 7, 7' despite higher viscosity and lower combustion efficiency.

In addition, a pump 34 is provided, with the aid of which the hydraulic system can be pressurized after a long stoppage.

For the cooling of the combustion chamber 8 a cooling coil 71 is disposed around the cylinder 6 and is covered by a jacket 72 of insulating material. The coil 71 is in communication at one end, via the pipe 73, with the outlet 4 of the hydraulic motor 1, and at the other end, via the pipe 74, with a cooler 75, and also, via the pipe 76, with the reservoir 5. In this way the combustion chamber 8 can thus be cooled with the aid of return oil from the hydraulic system.

In order to increase the cooling capacity of the cooler 75 under extreme conditions a fan 77 is provided, which is driven by the hydraulic motor 78, the latter being in communication with the accumulator 3 via the pipe 79 and the valve 80 contained in it.

In order to be able to cool the chamber 8 when the hydraulic motor 1 is at rest, so that there is no return oil flow, the valve 81 can be operated to enable cooled oil to be pumped from the reservoir 5 through the coil 71 by means of the pump 34.

Half of a form of construction of the free-piston unit according to the invention, of the type shown in FIG. 1, is shown in longitudinal section in FIG. 2. A free piston 36 is reciprocatingly slidable in the cylinder 35. The free piston 36 is connected to a tube 37 which is closed at the piston end and at the other end is provided with a radial thickening 38. A second tube 39 mounted in a fixed block 44 extends inside the tube 37, the inner periphery of the thickening 38 on the tube 37 making a sliding fit with the outer periphery of the tube 39, so that the tubes 37 and 39 form together a plunger chamber 40 which at 41 is in communication, via the pipe 14" an the operable valve member 32', with the accumulator 3', and which at the other end is bounded by the surface 42, of which the part delimited by the outside diameter of the tube 39 coincides with the surface 12 in FIG. 1. A bush-shaped member 43 is mounted at its one end in the fixed block 44 and at the other end in a body 45 connected to the wall of the cylinder 35. The bush-shaped member 43 is disposed coaxially around the tubes 37 and 39 in such a manner that the outer peripheral surface of the radial thickening 38 makes a sliding fit with the inside wall of the bush-shaped member 43, so that on one side of the thickening 38 an annular displacement chamber 46 having an operative surface 47 is formed, while on the other side of the thickening 38 a buffer chamber 48 having an operative surface 49 is formed. The displacement chamber 46 is in communication via the connection 50 with the pipe 19" leading to the liquid reservoir 5' and containing the nonreturn valve 20', and via the connection 51 to the pipe 21" leading to the accumulator 3' and containing the nonreturn valve 22". The buffer chamber 48 is in communication with the pipe 25" via the connection 52.

The embodiment shown in FIG. 2 has a compact construction and high efficiency. This high efficiency is achieved, inter alia, through the elastic deformation of the wall of the tube 39 during the compression stroke, whereby the clearance and consequently the leakage between the members 38 and 39 will be reduced.

During the expansion stroke there is no pressure differential over the tube 39, so that there is a greater clearance between 38 and 39 and therefore lower losses due to friction. Moreover, in this embodiment the surfaces which are difficult to machine are relatively small, so that production costs are lower.

FIG. 3 shows schematically a second form of construction of the apparatus according to the invention in which only the free-piston unit is shown.

This second form of construction differs from the first form substantially only in that the valve 26 in FIG. 1 is replaced by two valves 82, 83. Moreover also the single valves 31 and 28, 32 in FIG. 1 are replaced by two valves 84, 85 and two valves 86, 87 respectively.

The free-piston unit comprises a cylinder 88 containing two free-pistons 89 and 89' which are reciprocatingly slidable therein. Each piston 89, 89' is connected to a plunger-shaped member 90, 90' which comprises a first part 91, 91' which with its end surface delimits inside a chamber member 92, 92' a plunger-space 93, 93'. Said plunger-shaped member 90, 90' has a second part 94, 94' which delimits inside the chamber element 95, 95' at the one side a displacement chamber 96, 96' and at the other side a buffer chamber 97, 97'. Said displacement chamber 96, 96' is in communication via a pipe 98, 98' provided with a nonreturn valve 99, 99', with the liquid reservoir 100, and via a pipe 101, 101', provided with a nonreturn valve 102, 102' with the accumulator 103, whereas the buffer chamber 97, 97' is in communication via a line 104, 104' not only with the accumulator 103 but also via the valve 102 with the displacement chamber 96, 96'.

Each plunger-chamber 93, 93' is in communication with the accumulator 103 via an own separate operable valve member 82, 83 respectively so that a diversion from the symmetrical position of the pistons 89, 89' in their outermost positions inside the cylinder 88 can be corrected by opening one of the valve members 82, 83 slightly before the other valve member so that the compression stroke of the piston 89, 89' situated most to the outside inside cylinder 88 is initiated in advance of the compression stroke of the other piston. Thus the valve members 29, 29' which are provided for this correction purpose in FIG. 1 are disposed off in the second embodiment.

Further the liquid chambers 96, 96' can be brought into open communication with the reservoir 100 through pipe 105, 105' by opening the valve members 84, 85 respectively, while the plunger chambers 93, 93' can be brought into open communication with the liquid reservoir 100 by opening the valve members 86, 87 respectively so that because of the liquid pressure acting on the surfaces of the plunger shaped element which delimits the buffer chambers 97, 97', both pistons 89, 89' can be brought into the correct outer starting position.

Furthermore an adjustable constriction 84', 85' is provided, by means of which the speed at which the pistons are brought to the outer starting positions can be adjusted.

The second embodiment offers the advantage with respect to the first embodiment that each side of the free-piston unit requires only one intake and one outlet conduit so that the reliability of the apparatus is increased and the risk of failures is decreased. Furthermore a reduction of waiting time after each cycle is obtained, resulting in an increased top power output.

FIG. 4 shows an axial section of a form of construction of an operable valve member according to the invention, this form of construction being particularly suitable for the operable valves 29, 22; 29', 22'; 82 and 83.

The valve member comprises a body 53 which is tightly enclosed in the partially shown jacket 53'. The body has connections 54 and 55 for connection to the high pressure part, that is to say in the case of the previously described systems the accumulator side, and tee low pressure part respectively of the pipe in question. The connections 54 merges into a passage 56, which in turn merges into a chamber 56'. A bore 57 and a plurality of bores 58 and a plurality of bores 59 open into the chamber 56'.

The bores 58 bring the chamber 56' into open communication with the annular chamber 60, so that the high pressure prevails in said chamber 60.

The bores 59 also open into the annular chamber 60, while at this outlet point a valve seat is formed, onto which a preferably spherical valve body 61 is pressed by means of the spring 62, the high pressure inside chamber 60 acting on the top face of valve body 61 which faces away from said valve seat.

In addition, each bore 59 is in communication with a passage 63 which is in communication with the connection 55 on the low pressure side so that the low pressure acts on the bottom face of valve body 61. A pin-shaped member 64 is arranged to slide in each bore 59 and has a shoulder surface 65 which is directed towards the connection 54 and which delimits inside the bore 59 a chamber which is in communication with the space 69 via the passage 66, the annular space 67, and the transverse passage 68.

The bore 57, in which one or more (in the present case two) preloaded nonreturn valves are disposed, also leads out into the annular space 67, so that the space under the shoulder 65, the passage 66, the annular space 67, the passage 68 and the space 69 will always be filled with liquid under high pressure. In the body 53 at least one actuator, in the embodiment shown specifically a piezoelectric element 70 is disposed which drives a membrane- or plunger-shaped body 70', so that when a voltage is applied to an element of this kind a displacement of great power but short stroke is produced, which is converted by means of the hydrostatic transmission into a larger displacement of the pin-shaped member 64, whereby the spherical valve member 61 is lifted off its seat. This results in the establishment of communication between the annular space 60 and the passage 63, which means that the liquid can flow from the connection 54 through the passage 56, the chamber 56', the bores 58, the annular chamber 60, and the passage 63 to the connection 55. If in the closed situation the pressure at the connection 55 rises above the pressure at the connection 54, the balls 61 will be lifted off because of the pressure differential over these balls, and the liquid will flow from the connection 55, via the space 60, the bores 58, the chamber 56', and the passage 56 to the connection 54. In addition to its on-off function for a flow of liquid from the connection 54 to the connection 55, the valve thus has also a non-return function for an oppositely directed flow, so that with a single valve it is possible to replace an on-off valve and a nonreturn valve mounted in a bypass, as shown in FIG. 1, for example, at 29, 22; 26 and in FIG. 3 at 82, 83 and 86, 87.

What is claimed:

1. Apparatus for driving a member, such as a wheel, pulley, rod or similar member, comprising at least one rotary or linear motor which is coupled to said member and which is driven by a pressurized fluid, particularly a hydraulic motor or similar hydraulic apparatus, which on one side is in communication via a pipe with at least one accumulator for a pressurized fluid, particularly a liquid, and on the other side with an outlet leading to a reservoir for said liquid, and further comprising at least one free-piston unit consisting of a cylinder with at least one free piston which is slidable to-and-fro therein and which delimits a space within the cylinder in such a manner that on the expansion stroke of the piston, during which the latter is displaced in the other direction, the volume of the space is increased while on the compression stroke of the piston, during which the latter is displaced in the one direction, the volume of the space is reduced, while means are provided for the admission and discharge of a gas into and out of said space respectively, together with means for heating the gas compressed in said space by the compression stroke of the piston, the latter being connected to a member of general plunger-like shape which is adapted to slide to-and-fro inside at least one stationarily mounted chamber member, at least two parts of different diameters of the periphery of the plunger-shaped member making sliding fits with parts of the inside wall of the chamber member, while the plunger-shaped member has three substantially radial surfaces each of which delimits within the chamber member a substantially closed chamber whose capacity gradually varies as the piston makes its expansion and compression strokes, of which surfaces a first radial surface delimits a first or plunger chamber which is in communication with a source of pressurized fluid, and a second radial surface delimits a second or displacement chamber which is in communication via a nonreturn valve with the reservoir and is connected via a second nonreturn valve to the accumulator, so that during the stroke of the piston whereby the capacity of the second chamber is increased liquid is drawn out of the reservoir into this chamber and during the other, opposite stroke of the piston whereby the capacity of the second chamber is reduced this liquid is forced out of said chamber in order to load the accumulator, and the third radial surface has a smaller operative area than the first radial surface and delimits substantially inside the chamber member a third chamber, while its capacity increases and decreases respectively during the expansion and compression strokes of the piston, characterized in that the first or plunger-chamber is in communication with said source of pressurized fluid through an operable valve member so that by opening said valve member the piston makes it compression stroke and the third chamber is solely in open communication with said accumulator.

2. Apparatus according to claim 1, wherein said source of pressurized fluids is formed by said accumulator.

3. Apparatus according to claim 1, wherein said third chamber is in communication with the displacement chamber via a pipe containing a nonreturn valve.

4. Apparatus according to claim 1, wherein the cylinder contains two free pistons which move towards one another in the compression stroke and away from one another in the expansion stroke, and wherein both plunger chambers are in communication with said source of pressurized fluid through one common operable valve member.

5. Apparatus according to claim 1, wherein the cylinder contains two free pistons which move towards one another in the compression stroke and away from one another in the expansion stroke, and wherein each plunger chamber is in communication with said source of pressurized fluid through a separate operable valve member.

6. Apparatus according to claim 4, wherein the displacement chambers are each in communication with the accumulator via a pipe incorporating an operable valve member.

7. Apparatus according to claim 1, wherein the plunger chamber and the displacement chamber can each be selectively brought into communication with the reservoir by means of an operable valve.

8. Apparatus according to claim 7, wherein means defining an adjustable constriction is provided downstream of the operable valve in the connection between the displacement chamber and the reservoir.

9. Apparatus according to claim 1, wherein the cylinder of the free-piston unit is provided with jacketing for cooling the cylinder by means of the liquid, said jacketing being at one end in communication with the hydromotor outlet leading to the reservoir and at the other end in communication with the reservoir via a cooler.

10. Apparatus according to claim 9, wherein the cooler contains a hydraulically driven fan, the drive of which is connected at one end to the accumulator and at the other end to the reservoir.

11. Apparatus according to claim 1, wherein at least one of the operable valve members includes a body provided with respective connections to the high and low pressure parts of the pipe concerned and which has a through passage in which at least one valve element is received, with its bottom face resting on a seat, and is adapted to be moved away from and towards said seat, this passage being in communication at the end with the high pressure connection and at the other end with the low pressure connection, whereby the high pressure acts on the top face and the low pressure on the bottom face of the valve element, a pin-like member is disposed beneath said valve and is slidable inside a bore away from and towards the valve element, said member including at least one substantially radial surface deliminating a substantially closed space inside the bore in communication, with preloading, via nonreturn valves with the high pressure connection, whereby said space is always filled with the liquid under high pressure, and means for raising the pressure and supplying liquid, to displace said pin-like member and lift the valve element off its seat.

12. Apparatus according to claim 11, wherein said surface of the pin-like member is defined by a shoulder surface on the pin-like member directed away from the valve member, while the bore in which said pin-like member is received is in communication at the bottom end with the high pressure connection, whereby liquid under high pressure acts on said end surface of the pin-like member at a distance from said shoulder surface.

13. Apparatus according to claim 1, wherein the means for raising the pressure and supplying liquid are formed by at least one body driven by a piezoelectric element.

14. Apparatus according to claim 1, wherein two free pistons are disposed in the cylinder which in the compression stroke move towards one another and in the expansion stroke move away from each other, means defining inlet and outlet ports in the cylinder wall disposed symmetrically in relation to the centre of the cylinder, and wherein one free piston has a lower mass than the other free piston.

15. Apparatus according to claim 14, wherein the operative radial plunger and displacement surface areas associated with one free piston are of different size than those associated with the other free piston.

* * * * *